US006712648B2

(12) United States Patent
Padro et al.

(10) Patent No.: US 6,712,648 B2
(45) Date of Patent: Mar. 30, 2004

(54) LAMINATE ELECTRICAL INTERCONNECT SYSTEM

(75) Inventors: Kenny Padro, Hamden, CT (US); Robert D. Godburn, Jr., Waterbury, CT (US); William Keller, Litchfield, CT (US)

(73) Assignee: Litton Systems, Inc., Los Angeles, CA (US)

( * ) Notice: Subject to any disclaimer, the term of this patent is extended or adjusted under 35 U.S.C. 154(b) by 0 days.

(21) Appl. No.: 10/201,259

(22) Filed: Jul. 24, 2002

(65) Prior Publication Data

US 2004/0018776 A1 Jan. 29, 2004

(51) Int. Cl.[7] ..... H01R 13/502
(52) U.S. Cl. ..... 439/701; 439/63
(58) Field of Search ..... 439/701, 717, 439/79, 729, 723–724, 608, 578–585, 63

(56) References Cited

U.S. PATENT DOCUMENTS

| | | | | |
|---|---|---|---|---|
| 4,670,339 A | * | 6/1987 | Frey | 428/328 |
| 6,062,913 A | * | 5/2000 | Puerner | 439/687 |
| 6,491,545 B1 | * | 12/2002 | Spiegel et al. | 439/579 |
| 6,565,392 B2 | * | 5/2003 | Padro | 439/751 |

* cited by examiner

*Primary Examiner*—P. Austin Bradley
*Assistant Examiner*—Phuongchi Nguyen
(74) *Attorney, Agent, or Firm*—Lowe Hauptman Gilman & Berner, LLP

(57) ABSTRACT

An electrical connector having a laminate structure and multiple parallel grooves is described. The laminate structure is electrically conductive and is coated with an electrically non-conductive material. Each groove has a signal carrying path electrically insulated from the electrically conductive portion of the laminate structure, which is advantageously surrounded by the laminate structure, thereby forming a type of Faraday cage around the signal carrying path and creating a completely shielded electrical path.

16 Claims, 10 Drawing Sheets

LAMINATE ELECTRICAL INTERCONNECT SYSTEM

FIELD OF THE INVENTION

The present invention relates generally to electrical connectors, and more particularly, to a composite layered interconnect system. Even more particularly, the present invention relates to a high density electrical interconnect system having multiple shielded electrical paths.

BACKGROUND OF THE INVENTION

Backplane systems are comprised of a complex printed circuit board which is referred to as a backplane or motherboard, and several smaller printed circuit boards which are referred to as daughtercards which plug into the backplane. Each of the daughtercards includes one or more chips which are referred to as the driver/receiver, The driver/receiver sends and receives signals from the drivers/receivers on other daughtercards. A signal path is formed between the driver/receiver on a first daughtercard and the driver/receiver on the second daughtercard. The signal path includes an electrical connector that connects the first daughtercard to the backplane, a second electrical connector that connects the second daughtercard to the backplane and the second daughtercard having the driver/receiver that receives the carriage signals. Various drivers/receivers being used today can transmit signals to data rates between 5–10 Gb/second and greater. The limiting factor (data transfer rate) in the signal path are the electrical connectors which connect each daughtercard to the backplane. A need exists in the art for a high speed electrical connector capable of handling the required high speed transfer data.

Further, the receivers are capable of discriminating signals having only 5% of the original signal strength sent by the driver. Reduction in signal strength increases the importance of minimizing cross-talk between signal paths to avoid signal degradation or errors being introduced into digital data streams. With high speed, high density electrical connectors, it is even more important to minimize cross-talk. Most high density electrical connectors use stamped copper components for carrying electrical signals. These copper components are usually unshielded and thus there is cross-talk between signal carrying paths.

Thus, need exists in the art for a high speed electrical connector capable of handling high speed signals that reduces cross-talk between signal paths.

SUMMARY OF THE INVENTION

It is, therefore, an object of the present invention to provide an electrical connector in which separate signal paths are shielded from each other.

Another object of the present invention is to provide a low cost, high density electrical interconnect system which is simple to manufacture.

Yet another object of the present invention is to provide an electrical interconnect system having a dense array of signal carrying contacts and a shielded signal carrying path.

These and other objects of the present invention are achieved by an electrical connector including a plurality of layers wherein each layer has a first side and a second side. Each layer has longitudinal grooves in the first side and the second side. The longitudinal grooves are electrically conductive and each of the plurality of layers is adjacent to at least one other layer. A first layer has a first side not adjacent to another layer. A last layer has a second side not adjacent to another layer. A first side of each other layer is adjacent to a second side of another layer. A plurality of contacts is each engaged with a respective groove.

The foregoing and other objects of the present invention are achieved by an electrical connector including a first layer and a last layer and a plurality of intermediate layers. Each layer has a first surface and a second surface and each layer has a plurality of conductive traces on at least one of said first surface and the second surface. A plurality of contacts is each engaged with a respective groove.

The present invention is directed to an electrical connector having a laminate structure. The laminate structure has multiple parallel grooves. The laminate structure is electrically conductive and is coated with an electrically non-conductive material. Each groove has a signal carrying path which is advantageously surrounded by the laminate structure, thereby forming a type of Faraday cage around the signal carrying path and creating a completely shielded electrical path.

Still other objects and advantages of the present invention will become readily apparent to those killed in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figure of the accompanying drawings, wherein elements having the same reference numeral designation represent like elements throughout and wherein.

DETAILED DESCRIPTION OF THE INVENTION

Figure 1:
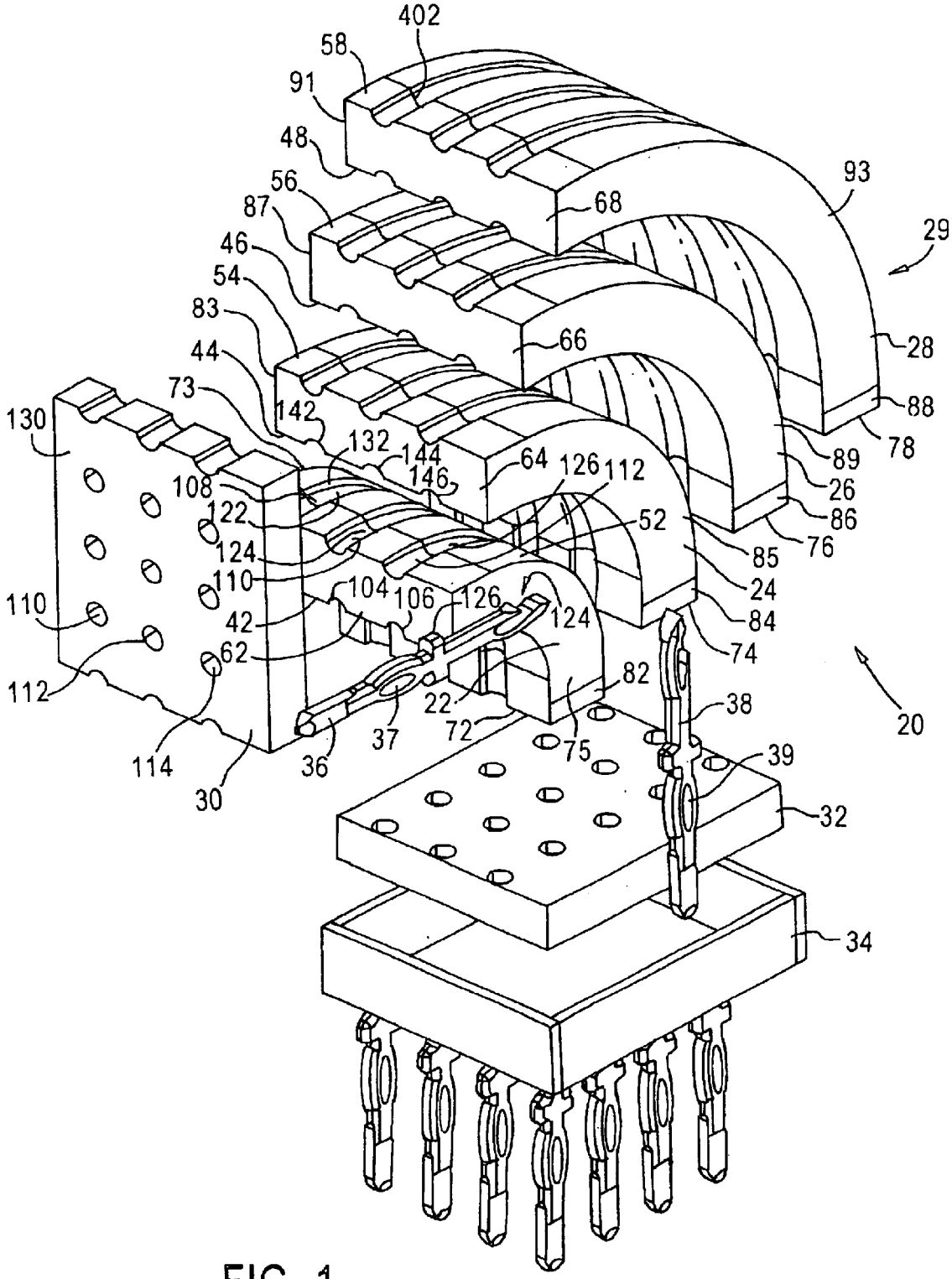
FIG. 1 is an exploded view of a first embodiment of the present invention and a laminated electrical interconnect system according to the principles of the present invention.
Figure 2:
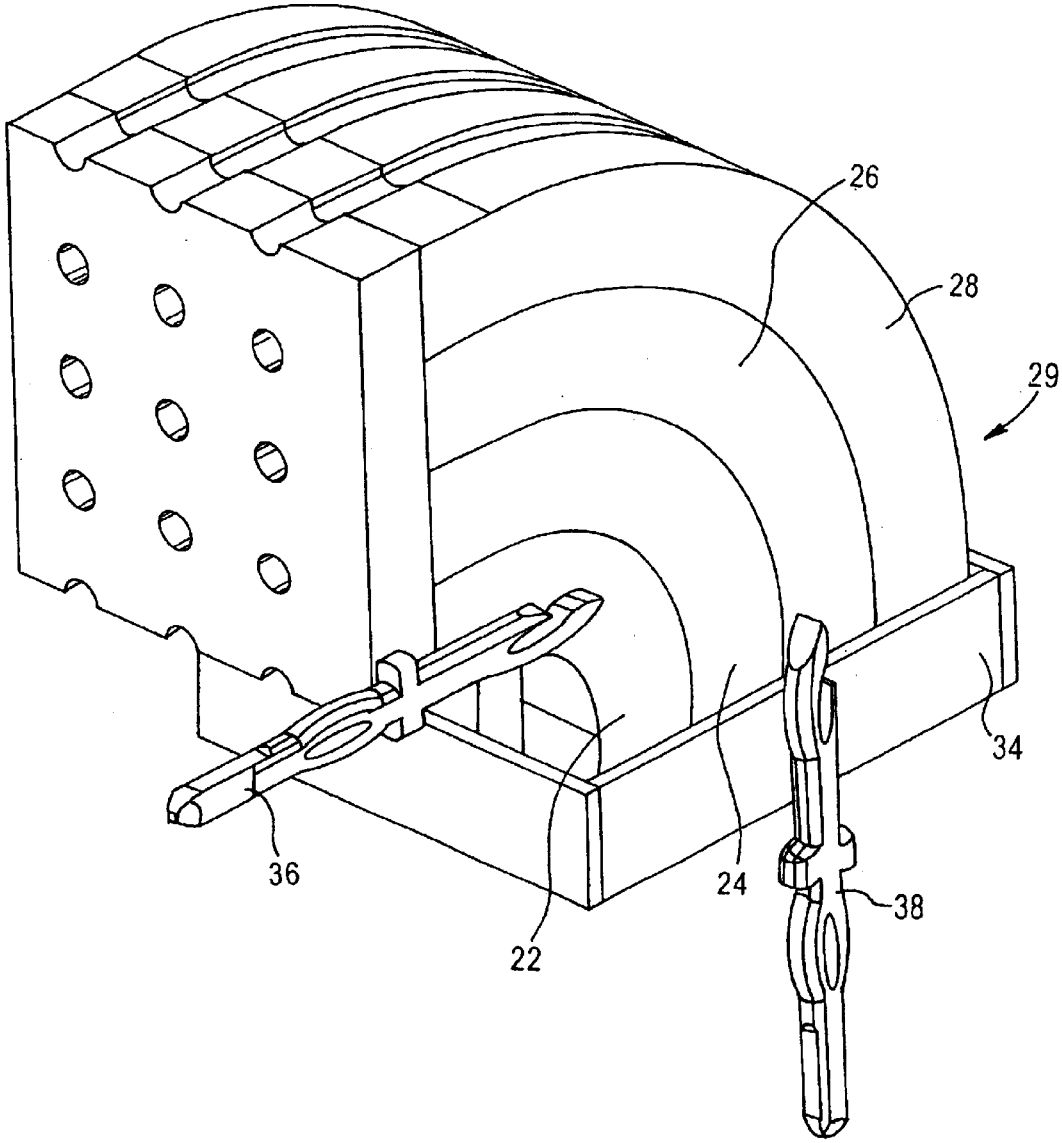
FIG. 2 is a perspective view of the electrical interconnect system of FIG. 1 fully assembled.

Refer first to FIG. 1, which is an exploded view of a horizontal first embodiment of an electrical connector according to the principles of the present invention. Electrical connector 20 includes a first layer 22, a second layer 24, a third layer 26, and a fourth layer 28 which together form a laminate structure 29. It is envisioned that the electrical connector would include many more layers than are shown in FIG. 1 and it is possible to have approximately 3000 signal lines in each electrical connector. Most preferably, the first embodiment of the electrical connector would have 15 layers each having 200 grooves for a total of 3000 signal paths. Each signal path has opposed contacts at opposite ends of the signal path.

Each of the layers 22, 24, 26, and 28 has an inner surface 42, 44, 46 and 48 respectively. Each layer 22, 24, 26, and 28 has an outer surface 52, 54, 56, and 58, respectively. Each of the layers 42, 44, 46 and 48 is preferably made from an electrically conductive material such as aluminum, brass or copper. Each of the layers 22, 24, 26, and 28 can either be molded or stamped from a metallic material and suitably insulated by plating with an appropriate dielectric material. Alternatively, each of the layers can be molded from a non-conductive material and suitably plated for shielding and then insulated with the appropriate dielectric material. The first layer 22 has a front edge 62 and an opposite back edge 72, both transverse to the longitudinal direction. The second layer 24 has a front edge 64 and a back edge 74 transverse to the longitudinal direction. The third layer 26 has a front edge 66 and a back edge 76. The fourth layer 28 has a front edge 68 and a back edge 78.

The first layer has a left side edge 73 and a right side edge 75. The second layer has a left side edge 83 and a right side edge 85. The third layer has a left side edge 87 and a right side edge 89. The fourth layer has a left side edge 91 and a right side edge 93. The first layer 22 has a smaller radius of curvature and each succeeding layer 24, 26 and 28 has a slightly larger radius of curvature such that the layers 22, 24, 26, and 28 are stackable on one another. Each layer 22, 24, 26, and 28 is aligned with the other layers such that right side edges 75, 85, 89, 93 are aligned and the left side edges 73, 83, 87, 91 are aligned.

Each of the four layers 72–78 is coated with an electrically non-conductive dielectric material such as anodize Teflon™, or ceramic. Layers 22, 24, 26, and 28 can be bonded together with a non-conductive epoxy placed in between layers or mechanically. It is important that the layers 22, 24, 26, and 28 are not electrically in contact with one another except that each of the layers 22, 24, 26, and 28 is connected to ground. Each of the layers 22, 24, 26, and 28 has an exposed portion 82–88, for example, on the right side edges 75, 85, 89, 93 thereof, respectively, which are connected to ground as discussed below.

As depicted in FIG. 1, layer 22 has three longitudinally inwardly extending lower grooves 102 (not shown), 104 and 106 which extend from the front edge 62 to the back edge 72. Although the grooves are depicted as semi-circular any shape can be used for ease of manufacture. The layer 22 also has three inwardly upper grooves 108, 110, 112. As depicted in FIG. 1, grooves 108, 110 and 112 each have a conductive trace 122, 124, 126, respectively, in a lower part of the groove. The conductive traces are placed in the grooves after the layers have been insulated and in this manner each of the traces is electrically separate from adjacent traces. For example, with respect to groove 108 a gap 132 exists between the conductive trace 122 and surface 52 so that there is no possibility of electrical contact between layer 22 and layer 24. As depicted in FIG. 1, the grooves 102, 104, 106 in the lower surface 42 can have conductive traces and a junction can be formed between a respective trace and an inserted electrical contact.

The layer 24 has lower longitudinal grooves 142, 144 and 146. The remaining grooves or layers 24, 26, and 28 are not discussed for clarity. The grooves 142, 144 and 146 can either have conductive traces or not depending on the application.

As depicted in FIG. 1, groove 142 can also have a conductive trace placed therein, for example, and the same signal can be carried by conductive traces 122 and 142 forming a single signal path through the conductor. Alternatively, each of the conductive traces 122, 142 can carry different signals permitting the use of differential-pairs of lines on each side of the conductive contact.

Although not shown in FIG. 1, additional grooves can be added to each of the layers for alignment between adjacent layers.

As depicted in FIG. 1, alignment guides 30 and 32 have a rectangular shape and each has a plurality of holes to align with respective holes at opposite ends of the laminate structure 29. For example, grooves 108 and 142 form roughly a circle and together provide an engagement area for a pin type contact 36 such as that disclosed in a patent application entitled "COMPLIANT SECTION FOR AN ELECTRICAL CONTACT", Ser. No. 09/965,869, filed on Oct. 1, 2001, assigned to the instant assignee, the disclosure of which is hereby incorporated by reference into this specification in its entirety.

Advantageously, the laminate structure 29 completely surrounds each of the signal carrying traces forming a Faraday cage and preventing cross-talk between adjacent traces and eliminating noise. A Faraday cage is an electrostatic screen. The electrostatic screen is a shield against electric flux consisting of a number of straight, narrowly separated rods or wires joined at only one end. The plurality of layers 22, 24, 26, and 28 from a type of Faraday cage for each signal contact by directing all magnetic fields created when a current travels through a wire directly to the underlying conductive layer which is then grounded.

The alignment guides are made from an electrically non-conductive material. Alignment guide 30 includes a row of holes 110, 112, 114 which are aligned with grooves 108, 142; 110, 144; and 112, 146, respectively. Contacts 36 are inserted into respective holes in alignment guide 30 and contacts 38 are inserted into alignment guide 32. The contacts 36, 38 serve to retain the alignment guides 30, 32 to the laminate structure 29.

The contacts 36, 38 are held into the backplane and daughtercard using a compliant section such as the eye of a needle 37, 39, respectively.

The preferred contact is a lance style type contact 36, 38 as depicted in FIG. 1. The lance style contact 36 has a lance portion 124, a hand guard portion 126 and a compliant section 37. Lance portion 124 of the contact 36 engages and mates with the traces forming a junction between the traces and the contact 36. For example, trace 122 is found in the groove 108 and is engaged with a contact 36. The geometry of the lance portion 124 is similar to the compliant section 37 except that the eye of the lance is slightly smaller to allow for smaller forces and one of the beams is not fixed on one end to almost simulate a thumb on a hand. A hand guard portion 126 is located between the lance portion 124 and the compliant section 37, 39 and engages with an outer surface 130 of the alignment guide 30. This connector is not limited to the lance contact.

A conductive wire/wire pad can be placed in parallel with each groove in the laminate and electrically connected to that laminate to form a more direct path to ground. For example, a very thin spun wire or flat conductive wire/strip that makes reliable contact, like a gasket, with parallel laminates may be placed between all or some data/signal carrying traces, but must ultimately be connected to ground.

The alignment guide 30 is retained as part of the connector by the plurality of contacts 36. The alignment guide 32 is retained to the plurality of layers by a plurality of contacts 38. A ground 34 has a hollow rectangular configuration and an inner surface of the ground 34 is in contact with the exposed surfaces 82, 84, 86 and 88 of the layers 22, 24, 26, and 28, respectively. The inner surface of ground 34 presses, i.e., is formed to mechanically flex against the exposed surfaces 82, 84, 86 and 88 of layers 22, 24, 26, and 28.

Figure 3:
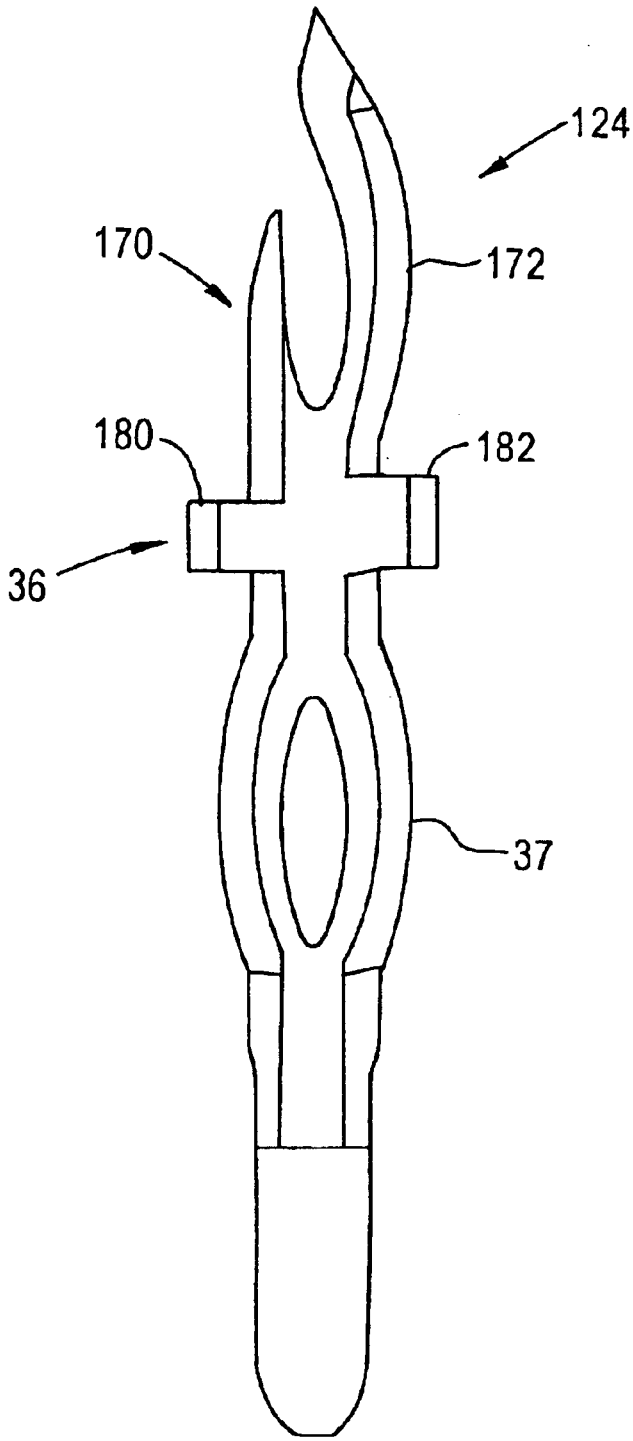
FIG. 3 is a plan view of a lance type electrical contact used with the electrical interconnect system.

Refer now to FIG. 3 where the lance type contact 36 is shown in greater detail. The lance section 124 includes a thumb portion 170 and a springy hand portion 172. The hand guard section 36 includes a first section 180 and a stepped section 182. Note that stepped section 182 is wider than first section 180 such that the contact can be keyed into holes 110, 112 and 114.

Figure 4:
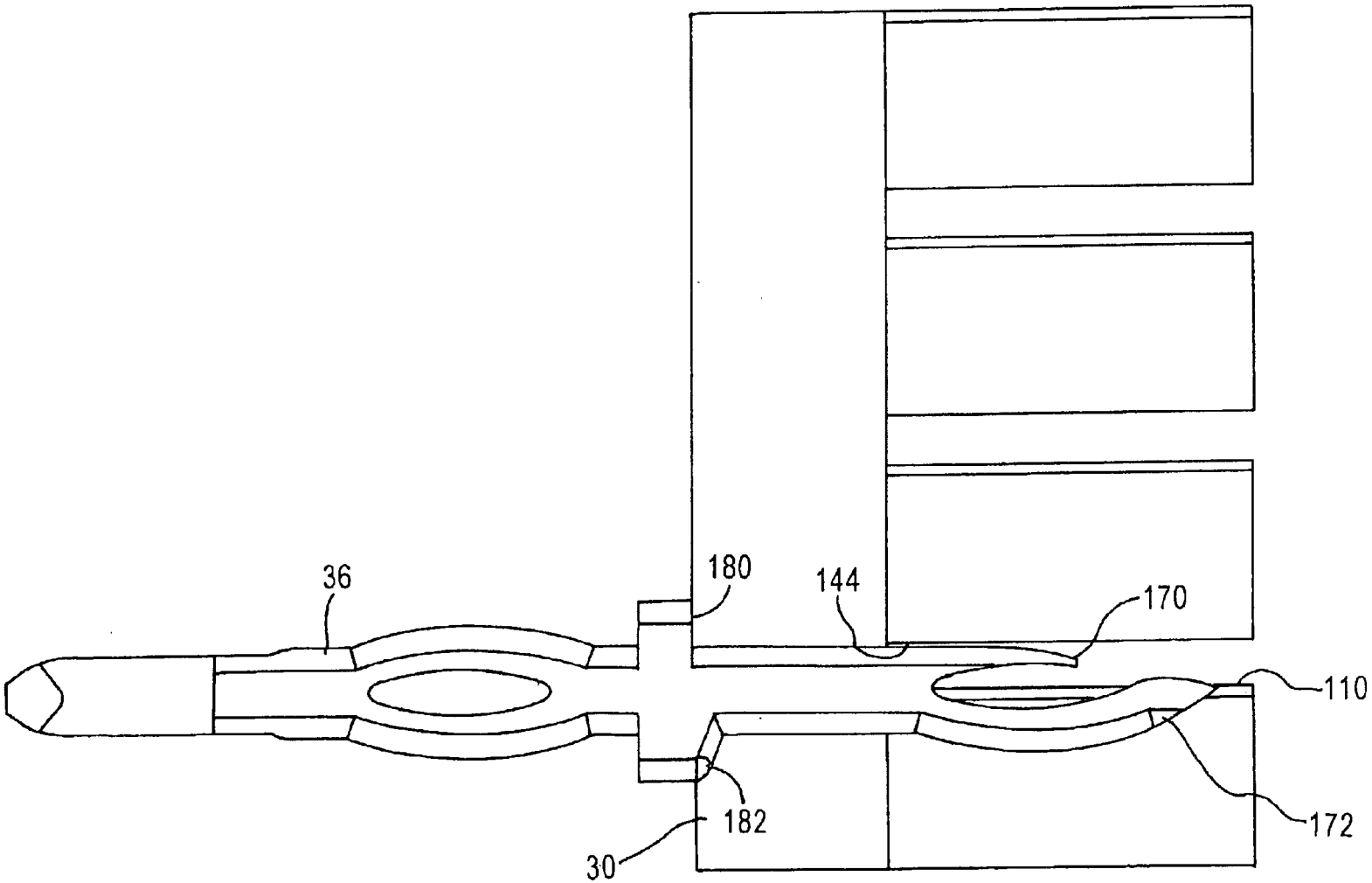
FIG. 4 is a cross-sectional view of the lance-type electrical contact engaged with the laminate structure.

Refer now to FIG. 4 illustrating a cross-sectional view of the electrical connector with a contact inserted through the alignment guide 30 into the laminate structure 29. The thumb portion 170 is in contact with groove 144 and the hand portion 172 is in contact with the groove 110. As depicted in FIG. 4, the hand portion 172 deflects in a direction away from groove 110. Also note that the step portion 182 engages with the alignment guide 30. The alignment guide 30 geometry is such that the contacts are oriented to mate with the trace in the groove. If only one conductive trace is used then it is preferable to have the hand portion 172 in contact with the one conductive trace.

Figure 5:
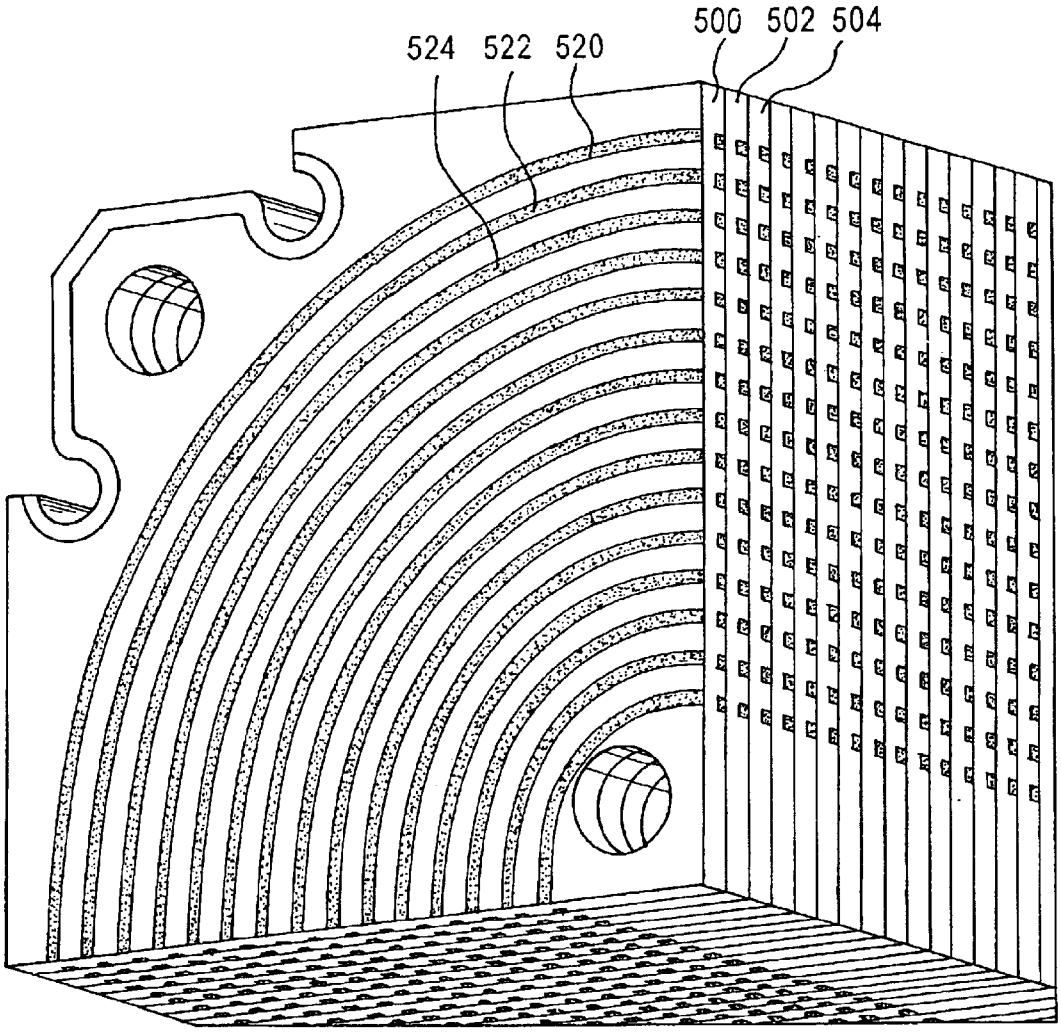
FIG. 5 is a perspective view of a second embodiment of the present invention in a horizontal configuration.

As depicted in FIG. 5, a second embodiment of the present invention is illustrated. The advantage to the second embodiment depicted in FIGS. 5–8 is that each of the laminates can be identical. In contrast, in the first embodiment, each of the layers 22, 24, 26, and 28 is not identical and would have to be stamped or molded in a different tool thus increasing cost and complexity. Each of the laminates 500, 502, 504, etc. is stacked one against another. Each laminate 500, 502, 504 can be made from either an electrically conductive material such as aluminum, copper or brass and then coated with an electrically non-conductive material or can be made from an electrically non-conductive material and then plated with an electrically conductive material.

Figure 6:
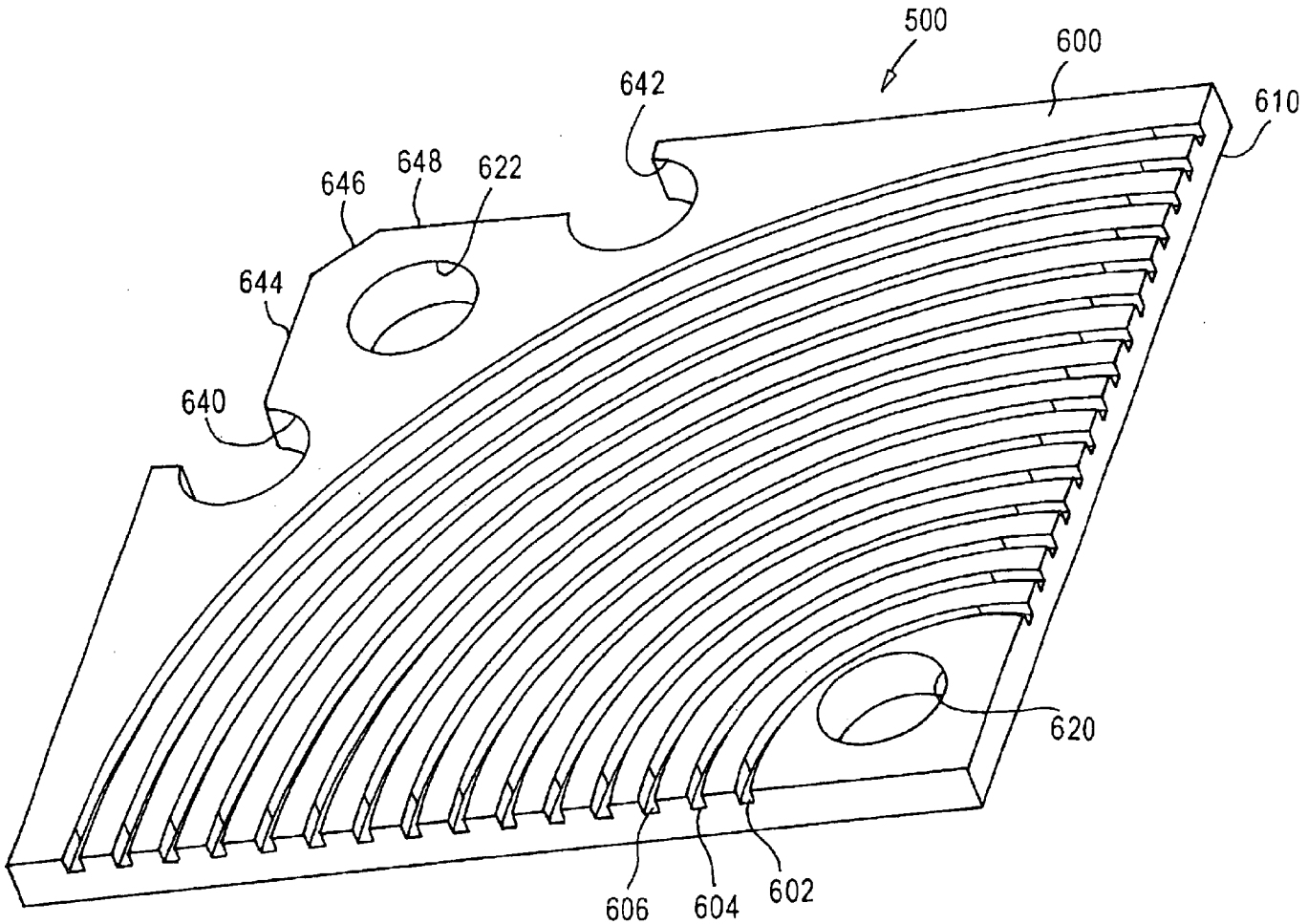
FIG. 6 is a perspective view of a laminate used in the FIG. 5 electrical connectors.
Figure 8:
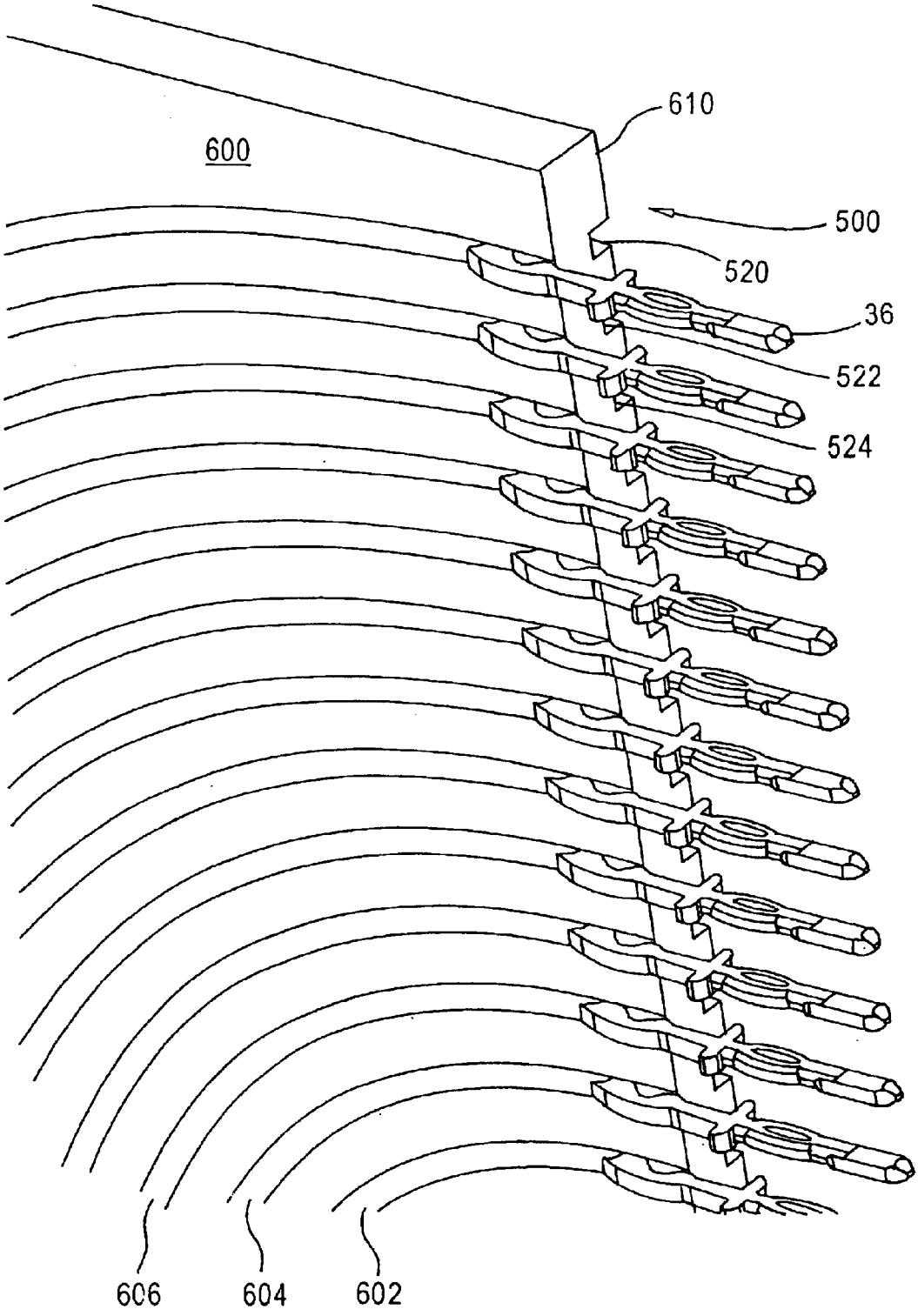
FIG. 8 is another perspective view of a layer of the second embodiment of FIG. 5 with electrical contacts engaged with the laminate.

FIG. 8 is a perspective view of a single laminate 500 according to the second embodiment described above. Multiple contacts are shown inserted into grooves on surface 600. In assembled form, two or more laminates are stacked side-by-side, as depicted in FIG. 5, and the grooves line up with the traces on surface 610. Contacts inserted in the grooves on surface 600, as depicted in FIG. 8, are in contact with the traces on surface 610 of the neighboring laminate (not shown). Each laminate has a plurality of circular segmented grooves 602, 604, 606 as depicted in FIG. 6. Grooves 602, 604, 606 extend inwardly from a surface 600. At the bottom of each of these grooves 602, 604, 606 is an electrically conductive trace. The conductive traces or signal lines can be precision stamped or printed on a PC board (single or double sided micro-strip, strip line or the like) or produced in shielded or unshielded flexible circuits. Referring back to FIG. 5, on the back surface 610, can be placed a plurality of conductive traces 520, 522, 524 as depicted in FIG. 5. These conductive traces 520, 522, 524, etc. can be used to provide a second signal path opposite a particular groove.

Figure 7:
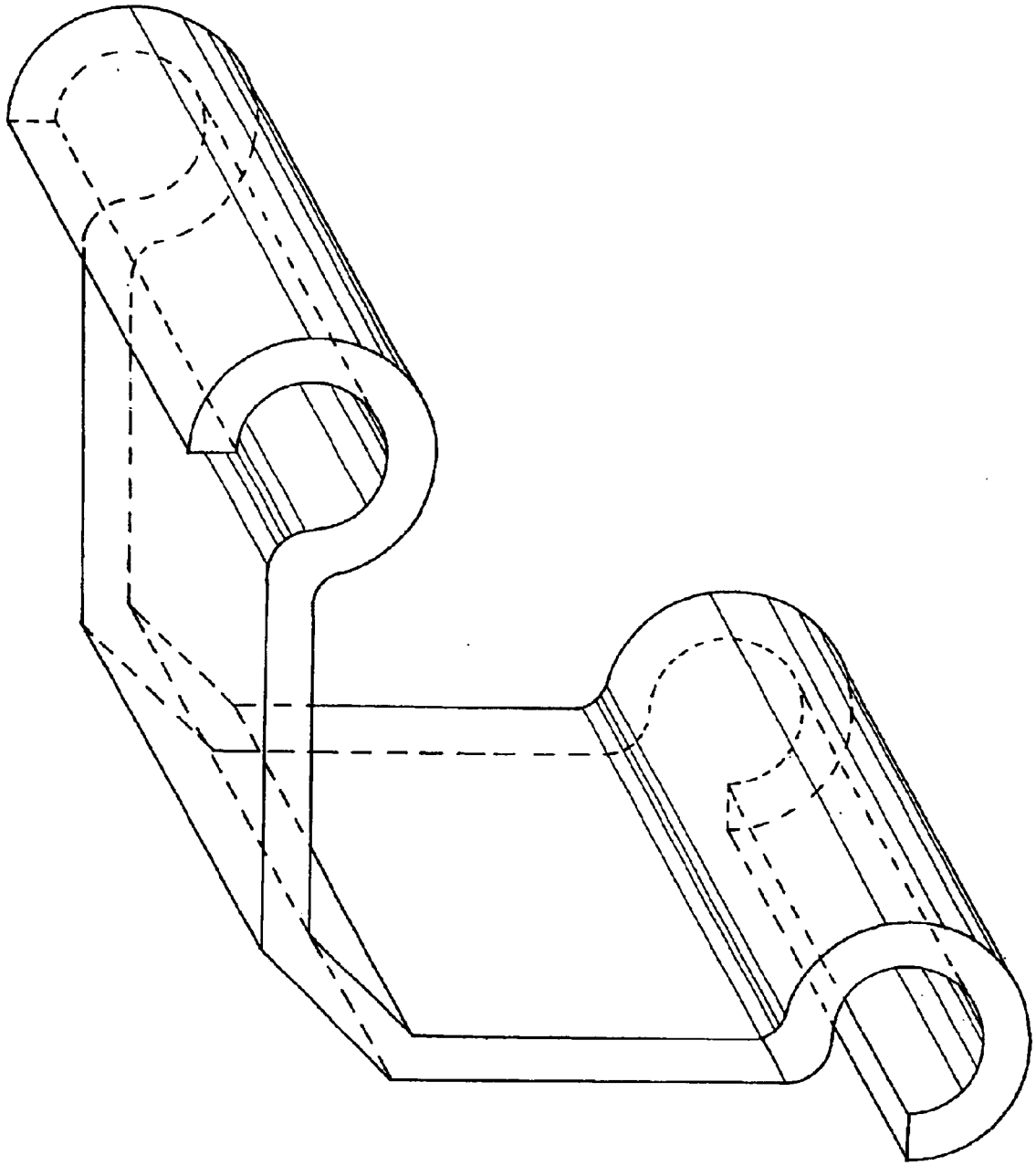
FIG. 7 is a ground spring used in the FIG. 5 electrical connector.

Laminate 500 has a through hole 620 in one comer thereof which can be used as an alignment hole. Another through hole 622 is an opposite corner thereof to align the stack of laminates 500, 502, 504. A conductive pin can be inserted through each holes 620, 622, through the entire length connector to stiffen up the connector assembly and to serve as a ground for grounding all the laminates together. Laminate 500 also has an exposed comer portion with a pair of holes 640, 642 connected by surfaces 644, 646, 648, respectively. Surfaces 644, 646, 648 are slightly within the periphery of laminate 500. A ground spring depicted in FIG. 7 is used to ground all the laminates together.

The conductive signals paths can be placed in the grooves 602, 604, 606 in each laminate as single sided or double sided, printed on a micro-strip, strip line or equivalent. Wires can also be placed into the grooves. The conductive signal paths can also be configured as a differential pair of signal contacts by having one signal path in groove 602, 604, 606 and a different signal path on traces 520, 522, 524.

Instead of a cantilever style contact depicted in FIG. 1, a compressible conductive pad, e.g., a Fuzz Button™, can be placed into the end of each groove making electrical contact with a trace and with the backplane or daughtercard.

Figure 9:
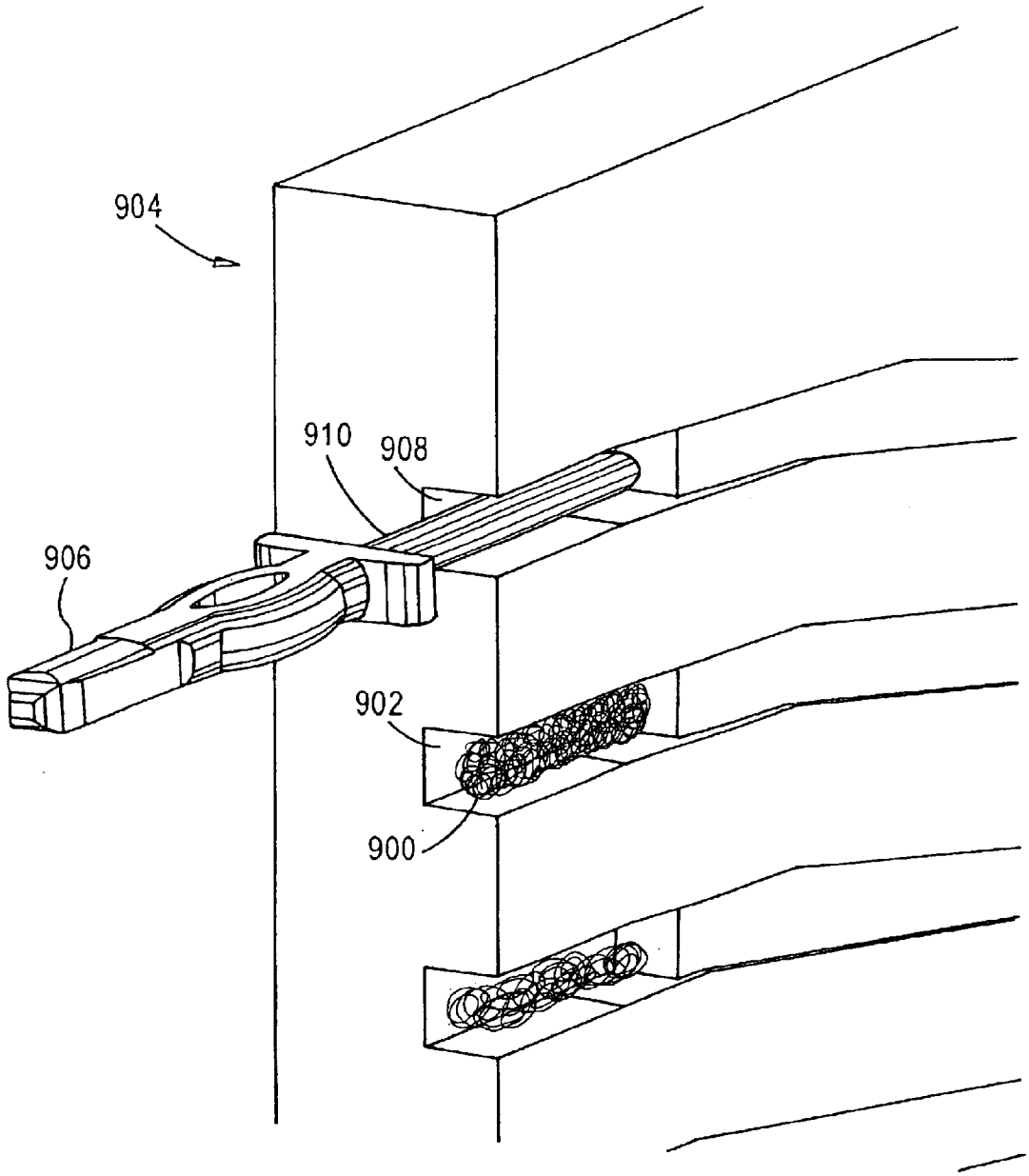
FIG. 9 is a perspective view of a layer of the second embodiment of FIG. 5 with an electrical contact engaged with a compressible conductive pad in a groove in the laminate.

FIG. 9 is a perspective view of a compressible conductive pad 900 in a groove 902 in a laminate 904 and a pin contact 906 inserted into another groove. Pin contact 906 differs from lance-style contact 36 (FIG. 3) by having an elongated cylindrical portion 910 in place of lance section 124. In an alternate embodiment, the cylindrical portion 910 may be a chamfered cylindrical piece for sliding beside the compressible pad 900. Insertion of contact 906 into a groove 908 containing a compressible conductive pad (not shown) creates a large contact area between the contact 906 and the trace (not shown) in the groove 908.

Figure 10:
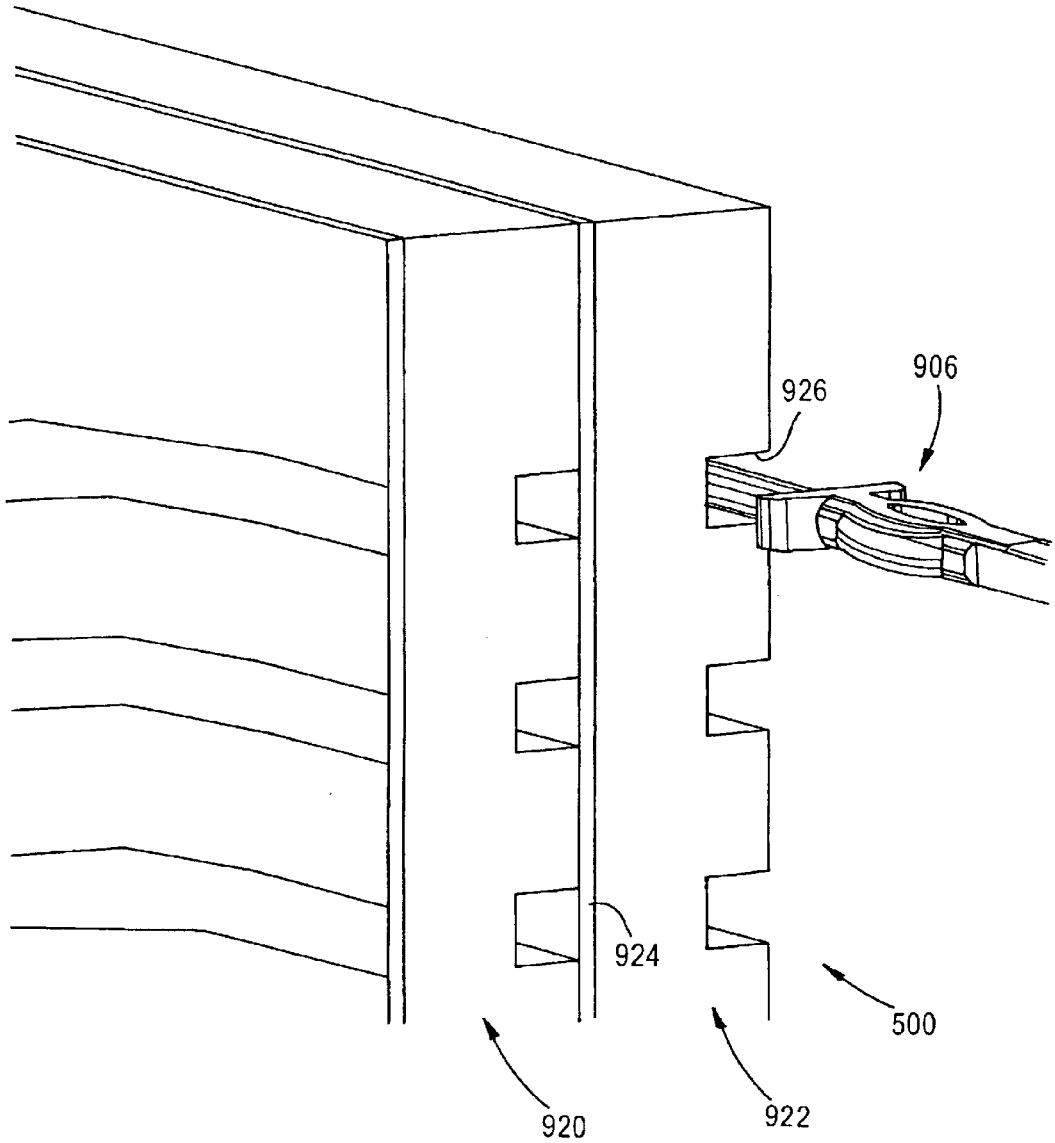
FIG. 10 is a perspective view of two layers of the second embodiment of FIG. 5 with a micro-strip positioned between the layers.

FIG. 10 is a perspective view of two adjacent layers 920, 922 in a laminate 500 as described above, wherein a micro-strip 924 is positioned between the adjacent layers 920, 922. An additional micro-strip (not shown) would be positioned on the other side of layer 922 oppose micro-strip 924 and layer 920. A contact 906 is inserted in a groove 926 of one of the layers 922 for contacting the additional micro-strip (not shown). Contact 906 may be either a lance-style contact, e.g., contact 36 of FIG. 3, or a contact 906 of FIG. 9 contacting a compressible pad (not shown) and thereby being in conductive contact with a micro-strip (not shown).

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electrical connector, comprising:

a plurality of layers each having a first side and a second side, each of said plurality of layers having longitudinal grooves in at least one of said first side and said second side, each of said longitudinal grooves being electrically conductive, each of said plurality of layers being adjacent at least one other layer with a first layer having a first side not adjacent to another layer and a last layer having a second side not adjacent to another layer and with a first side of each other layer being adjacent to a second side of another layer each of said longitudinal grooves being electrically insulated from all other longitudinal grooves; and a plurality of contacts each electrically engaged with a respective groove;

wherein each of said plurality of layers is made of an electrically conductive material and has an electrically non-conductive coating thereon, said longitudinal grooves being electrically insulated from said conductive material by said non-conductive coating.

2. The electrical connector of claim 1, wherein each of said plurality of layers is identical.

3. The electrical connector of claim 1, wherein said electrical connector is a right angle connector.

4. The electrical connector of claim 1, further comprising a first alignment guide at one end of said plurality of layers and a second alignment guide at an opposite end of said plurality of layers, each of said alignment guides having a plurality of through holes through which a corresponding one of said plurality of contacts extends.

5. The electrical connector of claim 1, wherein each of said plurality of layers is electrically connected to ground.

6. The electrical connector of claim 1, wherein each of said longitudinal grooves extends inwardly from said first side or said second side.

7. The electrical connector of claim 1, wherein each of said grooves has one of a semi-circular cross-section and a rectangular cross-section.

8. The electrical connector of claim 1, wherein each of said plurality of layer has an exposed portion which is electrically connected to ground.

9. The electrical connector of claim 1, wherein said plurality of layers are bonded together with a non-conductive epoxy.

10. An electrical connector comprising:

a first layer and a last layer and a plurality of intermediate layers, each layer having a first surface and a second surface with each layer having a plurality of conductive traces on at least one of said first surface and said second surface, each conductive trace being electrically insulated from all other traces; and a plurality of contacts each electrically engaged with a respective trace;

wherein each of said layers is made of an electrically conductive material and has an electrically non-conductive coating thereon, said traces being electrically insulated from said conductive material by said non-conductive coating.

11. The electrical connector of claim 10, wherein said electrical connector is a right angle connector.

12. The electrical connector of claim 10, wherein each of said layers is electrically connected to ground.

13. The electrical connector of claim 10, wherein said first layer has a smaller radius and each succeeding layer has a larger radius.

14. An electrical connector, comprising:

a first plurality of layers each having a first side and a second side with a first side of intermediate layers being adjacent a second side of an adjacent layer, each of said plurality of layers having at least one electrically conductive longitudinal groove each groove being electrically insulated from all other grooves; and a plurality of contacts each electrically engaged with a respective groove;

wherein each of said plurality of layers is made of an electrically conductive material and has an electrically non-conductive coating thereon, said grooves being electrically insulated from said conductive material by said non-conductive coating.

15. The electrical connector of claim 14, wherein said electrical connector is a right angle connector.

16. The electrical connector of claim 14, wherein each of said plurality of layers is electrically connected to ground.

* * * * *